United States Patent [19]

Waters

[11] 3,963,147

[45] June 15, 1976

[54] DISPENSER FOR AMORPHOUS MATERIAL

[75] Inventor: John Lawrence Waters, Los Angeles, Calif.

[73] Assignee: The Raymond Lee Organization, Inc., New York, N.Y. ; a part interest

[22] Filed: Jan. 8, 1975

[21] Appl. No.: 539,449

[52] U.S. Cl. ..... 222/95; 222/105; 222/213; 222/560

[51] Int. Cl.[2] ..... B65D 35/28; B65D 35/48

[58] Field of Search ..... 222/95, 96, 105, 213, 222/402.12, 560

[56] References Cited

UNITED STATES PATENTS

| | | | |
|---|---|---|---|
| 1,715,335 | 5/1929 | Cocks | 222/95 |
| 3,154,224 | 10/1964 | Wakeman | 222/402.12 |
| 3,217,933 | 11/1965 | Watson | 222/96 |
| 3,380,631 | 4/1968 | Perrinvaquet | 222/96 |
| 3,662,926 | 5/1972 | Umstead | 222/95 |

*Primary Examiner*—Robert B. Reeves
*Assistant Examiner*—Frederick R. Handren
*Attorney, Agent, or Firm*—Daniel Jay Tick

[57] ABSTRACT

A rigid housing accommodates a flexible envelope of amorphous material. The housing has air under pressure therein and an open end coincident with the open end of the envelope of material. A housing cover of flexible material encloses the open end of the housing and has an opening formed through the housing cover. A valve opens and closes the opening to permit the passage of material from the envelope. A dispenser unit is removably affixed to the housing at the cover thereof and has a tubular member extending at one end into the envelope of material via the opening in the cover of the housing and has a valve in the area of the other end of the tubular member and a valve intermediate both ends.

2 Claims, 4 Drawing Figures

FIG. 1
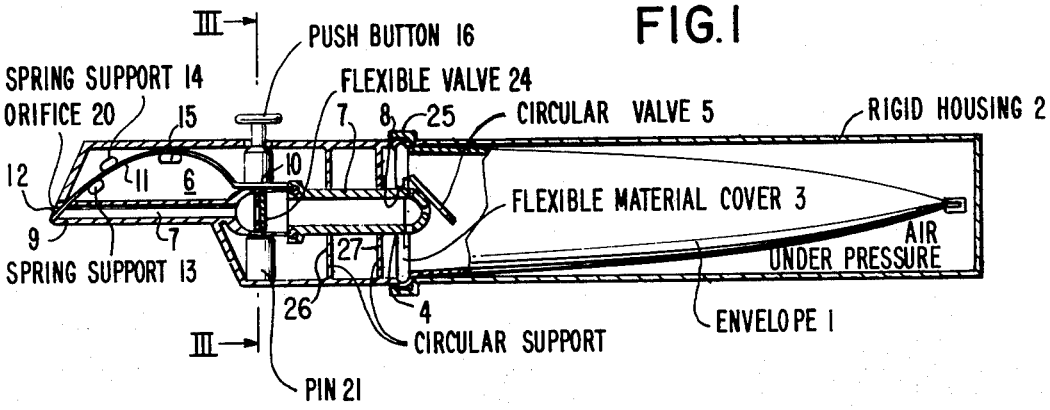
FIG. 2
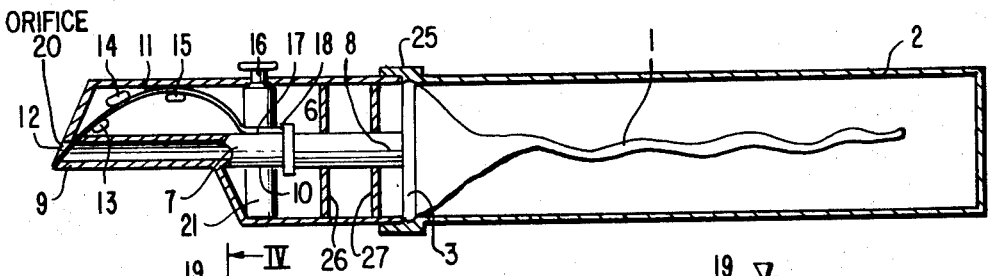
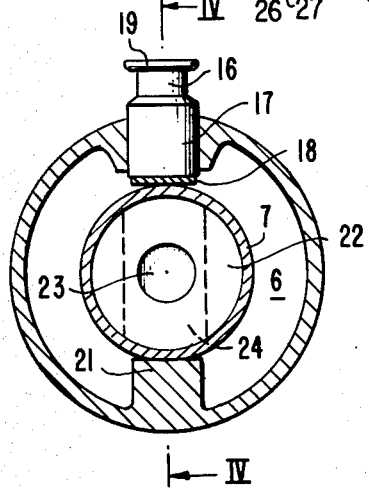
FIG. 3
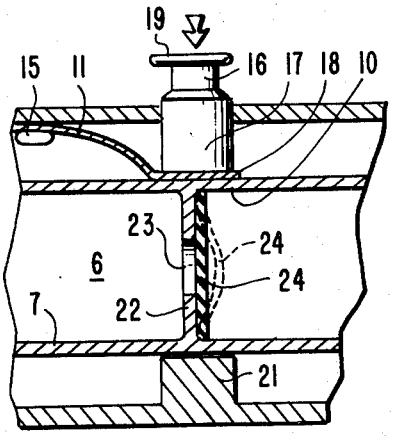
FIG. 4

DISPENSER FOR AMORPHOUS MATERIAL

DESCRIPTION OF THE INVENTION

The present invention relates to a dispenser for amorphous material. More particularly, the invention relates to a dispenser for amorphous material stored in a flexible envelope.

Objects ot the invention are to provide a dispenser for amorphous material of simple structure, which is inexpensive in manufacture, utilized with facility and convenience and functions efficiently, effectively and reliably to provide desired amounts of amorphous material such as, for example, toothpaste, creams, lotions, and the like, without waste.

In order that the invention may be readily carried into effect, it will now be described with reference to the accompanying drawing, wherein:

FIG. 1 is a view, partly in section, of an embodiment of the dispenser of the invention with a full envelope of amorphous material;

FIG. 2 is a view, partly in section, of the embodiment of FIG. 1 with a substantially empty envelope of amorphous material;

FIG. 3 is a view, partly in section, taken along the lines III—III, of FIG. 1; and FIG. 4 is a view, partly in section, taken along the lines IV—IV, of FIG. 3.

In the FIGS., the same components are identified by the same reference numerals.

The dispenser of the invention is for amorphous material such as, for example, toothpaste, pastes, creams, lotions, and the like, stored in a flexible envelope 1 (FIGS. 1 and 2).

A substantially rigid housing 2 (FIGS. 1 and 2) accommodates the flexible envelope 1 of material. The housing has air under pressure therein and has an open end coincident with the open end of the envelope 1 of material. A housing cover 3 (FIG. 1) of substantially flexible material encloses the open end of the housing 2 and has an opening 4 formed therethrough. A valve 5 of substantially disc-like flexible material opens and closes the opening 4 to permit the passage of material from the envelope 1 (FIG. 1).

In accordance with the invention, a dispenser unit, generally indicated by the reference numeral 6 (FIGS. 1 to 4), is removably affixed to the housing 2 at the cover 3 thereof. The dispenser unit 6 and the housing 2 are removably affixed to each other by any suitable means such as, for example, an internally threaded collar 25 extending from the housing and threadedly coupled to the dispenser unit via external threading around the end of said dispenser unit (FIGS. 1 and 2). The dispenser unit 6 has a substantially tubular member 7 (FIGS. 1 to 4) extending at one end 8 (FIGS. 1 and 2) into the envelope 1 of material via the opening 4 in the cover 3 of the housing. The tubular member 7 is supported in position by disc-like circular supports 26 and 27 (FIGS. 1 and 2).

A pair of valves are provided, one in the area of the other end 9 (FIGS. 1 and 2) of the tubular member 7 and the other intermediate both ends 8 and 9 of said tubular member. Part 10 (FIGS. 1, 2 and 4) of the tubular member 7 houses one of the valves and comprises substantially flexible material.

The valve at the end 9 of the tubular member 7 comprises a substantially arcuate spring 11 (FIGS. 1, 2 and 4) in the dispenser unit 6. The arcuate spring 11 has one end 12 (FIGS. 1 and 2) in operative proximity with the end 9 of the tubular member 7.

A guide arrangement, comprising a plurality of spring supports 13, 14 and 15 (FIGS. 1 and 2), in the dispenser unit 6 guides the movement of the spring 11. A push-button 16 (FIGS. 1 to 4) is movably mounted in the dispenser unit 6 and is affixed at one end 17 (FIGS. 2 to 4) to the other end 18 of the arcuate spring 11 (FIGS. 2 to 4) in operative proximity with the flexible material part 10 of the tubular member 7. The other end 19 of the push-button 16 extends out of the dispenser unit 6. Spring action of the spring 11 maintains the end 12 of the spring in blocking position closing an orifice 20 at the end 9 of the tubular member 7. Depression of the push-button 16 moves the spring 11 in the guide device 13, 14, 15 in a manner whereby the end 12 of the spring is moved to open position opening the orifice 20 at the end 9 of the tubular member 7.

The valve in the tubular member 7 intermediate the ends 8 and 9 thereof comprises a substantially rigid pin 21 FIGS. 1 to 4) mounted in the dispenser unit 6 in substantially axial alignment with the push-button 16 and in operative proximity with the flexible material part 10 of the tubular member in substantially diametrically opposed relation with the push-button. A wall 22 (FIGS. 3 and 4) of substantially flexible material in the tubular member 7 extends between the push-button 16 and the pin 21 and has a substantially axial hole 23 (FIGS. 3 and 4) formed therethrough. A substantially flexible flap-like member 24 (FIGS. 1, 3 and 4) is provided in the tubular member 7 next-adjacent the wall 22 therein. The member 24, as shown in solid lines in FIG. 4, covers the hole 23 through the wall 22 when the push-button 16 is in raised position. The member 24, as shown in broken lines in FIG. 4, buckles when the push-button 16 is depressed and compresses said member between said push-button and the pin 21 thereby uncovering the hole 23 through the wall 22 and permitting material to pass through said hole.

While the invention has been described by means of a specific example and in a specific embodiment, I do not wish to be limited thereto, for obvious modifications will occur to those skilled in the art without departing from the spirit and scope of the invention.

I claim:

1. A dispenser for substantially amorphous material stored in a flexible envelope, said dispenser comprising a substantially rigid housing accommodating a flexible envelope of material, said housing having air under pressure therein and having an open end coincident with the open end of the envelope of material and a housing cover of substantially flexible material enclosing the open end of the housing and having an opening formed through the housing cover and a valve for opening and closing the opening to permit the passage of material from the envelope; and a dispenser unit removably affixed to the housing at the cover thereof and having a substantially tubular member extending at one end into the envelope of material via the opening in the cover of the housing and having valve means in the area of the other end of the tubular member and intermediate both ends, part of said tubular member comprising substantially flexible material, and said valve means comprising substantially arcuate spring means in the dispenser unit having one end in operative proximity with the other end of the tubular member, guide means in the dispenser unit for guiding movement of the spring means and a push-button movably mounted in the dispenser unit and affixed at one end to the other end of the spring means in operative proximity with the flexible material part of the tubular member and extending out of the dispenser unit at the other end of the push-button whereby spring action of the spring means maintains the one end of the spring means in blocking position closing the other end of the tubular member and depression of the push-button moves the spring means in the guide means in a manner whereby the one end of the spring means is moved to open position opening the other end of the tubular member.

2. A dispenser as claimed in claim 1, wherein the valve means further comprises a substantially rigid pin mounted in the dispenser unit in substantially axial alignment with the push-button and in operative proximity with the flexible material part of the tubular member in substantially diametrically opposed relation with said push-button, a wall of substantially flexible material in the tubular member extending between the push-button and the pin and having a substantially axial hole formed therethrough, and a substantially flexible flap-like member in the tubular member next-adjacent the wall therein and covering the hole through the wall when the push-button is in raised position and buckling when the push-button is depressed and compresses said flap-like member between said push-button and the pin thereby uncovering the hole through said wall and permitting material to pass through said hole.

* * * * *